US012673355B2

(12) United States Patent
Kobayashi et al.

(10) Patent No.: US 12,673,355 B2
(45) Date of Patent: Jul. 7, 2026

(54) BURRING STRUCTURAL MEMBER

(71) Applicant: NIPPON STEEL CORPORATION, Tokyo (JP)

(72) Inventors: Shunsuke Kobayashi, Tokyo (JP); Ryoma Kato, Tokyo (JP); Hiroshi Shuto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/726,073

(22) PCT Filed: Apr. 5, 2023

(86) PCT No.: PCT/JP2023/014139
§ 371 (c)(1),
(2) Date: Jul. 1, 2024

(87) PCT Pub. No.: WO2023/195496
PCT Pub. Date: Oct. 12, 2023

(65) Prior Publication Data

US 2025/0065389 A1 Feb. 27, 2025

(30) Foreign Application Priority Data

Apr. 6, 2022 (JP) ..... 2022-063610

(51) Int. Cl.

| | |
|---|---|
| ***B21D 19/08*** | (2006.01) |
| ***A61B 17/16*** | (2006.01) |
| ***C22C 38/12*** | (2006.01) |
| ***C22C 38/22*** | (2006.01) |
| ***C22C 38/48*** | (2006.01) |

(52) U.S. Cl.
CPC ..... *B21D 19/08* (2013.01)

(58) Field of Classification Search
CPC ..... B21D 19/08; B21D 28/26; B21D 19/005
USPC .. 29/432, 21.1, 283.5, 243.54, 432.1, 432.2, 29/459, 509, 512, 521, 523, 243.52, 29/243.53, DIG. 7, 243.5, 798
See application file for complete search history.

(56) References Cited

U.S. PATENT DOCUMENTS 1,278,243 A * 9/1918 Sonnebom ..... F28F 9/0224 165/DIG. 476
4,611,381 A * 9/1986 La Barge ..... B23P 11/00 29/21.1
9,929,385 B2 * 3/2018 Jeong ..... H01M 50/224
(Continued)

FOREIGN PATENT DOCUMENTS

WO WO 2020/184372 A1 9/2020

*Primary Examiner* — Lawrence Averick
(74) *Attorney, Agent, or Firm* — Birch, Stewart, Kolasch & Birch, LLP

(57) ABSTRACT

A burring structural member resistant to fracture even if the burring structural part is bent back is provided. In the burring structural member of the present disclosure, a thickness T of the sheet-shaped part is 2.0 mm or more, a Charpy impact value vE(0) of the sheet-shaped part at 0° C. is 50 J/cm$^2$ or more, a BCI value calculated by BCI=vE(0)/Lc based on the Charpy impact value vE(0) (J/cm$^2$) and a maximum length Lc (μm) of a crack at the inside bend of the bent wall part of the burring structural parts is 2.5 or more, and a curvature radius R (mm) of the inside bend of the bent wall part is larger than R1 calculated by R1=25/BCI−1.5.

5 Claims, 7 Drawing Sheets

(56) References Cited

U.S. PATENT DOCUMENTS

| | | | | |
|---|---|---|---|---|
| 2009/0098404 | A1* | 4/2009 | Matsuyama | B21D 28/26 73/788 |
| 2013/0230759 | A1* | 9/2013 | Jeong | H01M 50/548 429/99 |
| 2022/0090228 | A1 | 3/2022 | Abukawa et al. | |

* cited by examiner

BURRING STRUCTURAL MEMBER

FIELD

The present application discloses a burring structural member.

BACKGROUND

As parts which are light in weight and high in strength, parts made of high strength steel have been developed. For example, by processing high strength steel sheet for burring, a burring structural member is obtained. If steel sheet is to be processed for burring, the steel sheet is preferably excellent in bendability. For example, PTL 1 discloses the art of making the area of scale marks at a steel sheet surface a predetermined area or less to thereby suppress cracks at an inside bend occurring at steel sheet at the time bending is applied.

CITATIONS LIST

Patent Literature

[PTL 1] WO2020/184372

SUMMARY

Technical Problem

A burring structural member is often utilized for parts subjected to external force. For example, it can be envisioned that a burring wall part would be bent back upon receiving external force. In a conventional burring structural member, if a burring wall part is bent back or is compressed, the burring wall part is liable to fracture before the desired properties (maximum load etc.) are exhibited. On this point, in a conventional burring structural member, there is room for improvement in the fracture resistance when a burring wall part is bent back or compressed.

Solution to Problem

When a burring wall part is bent back or compressed, one of the causes for the burring wall part to fracture is a crack present at an inside bend of the burring wall part. Here, according to new findings of the inventors, the critical length of a crack at an inside bend of a burring wall part causing fracture differs depending on the toughness of the burring structural member and the bent shape of the burring wall part etc. The inventors discovered that if a curvature radius R of an inside bend of a burring wall part and an indicator relating to toughness and cracking at the inside bend (BCI value=toughness value vE(0)/maximum length Lc of crack at inside bend) satisfy predetermined conditions, it is possible to suppress fracture at the time when a burring wall part is bent back or compressed.

The present application discloses the following aspects as means for solving the above problem:

<Aspect 1>

A burring structural member comprising:

a burring hole:

a burring wall part provided around the burring hole and having a vertical wall part and a bent wall part connected to the vertical wall part; and a sheet-shaped part provided around the burring wall part and connected to the bent wall part, wherein a thickness T of the sheet-shaped part is 2.0 mm or more, a Charpy impact value vE(0) of the sheet-shaped part at 0° C. is 50 J/cm$^2$ or more, a BCI value calculated by the following formula (1) based on the Charpy impact value vE(0) and a maximum length Lc of a crack at an inside bend of the bent wall part is 2.5 or more, and a curvature radius R of the inside bend of the bent wall part is larger than R1 calculated by the following formula (2):

$$BCI = vE(0)/Lc \quad (1)$$

$$R1 = 25/BCI - 1.5 \quad (2)$$

where, the unit of vE(0) is J/cm$^2$, the unit of Lc is μm, and the unit of R1 is mm.

<Aspect 2>

The burring structural member of the aspect 1, wherein the curvature radius R of the bent wall part is 0.5 mm or more and 10.0 mm or less.

<Aspect 3>

The burring structural member of the aspect 1 or 2, wherein the thickness T of the sheet-shaped part is 2.0 mm or more and 8.0 mm or less.

<Aspect 4>

The burring structural member of any of the aspects 1 to 3, wherein a tensile strength TS of the sheet-shaped part is 780 MPa or more.

<Aspect 5>

The burring structural member of the aspect 4, wherein the tensile strength TS of the sheet-shaped part is 980 MPa or more.

Advantageous Effects of Invention

In the burring structural member of the present disclosure, the burring structural part is resistant to fracture even if the burring structural part is bent back or is compressed.

DESCRIPTION OF EMBODIMENTS

Below, one embodiment of a burring structural member of the present disclosure will be explained, but the burring structural member of the present disclosure is not limited to the embodiment.

Figure 1:
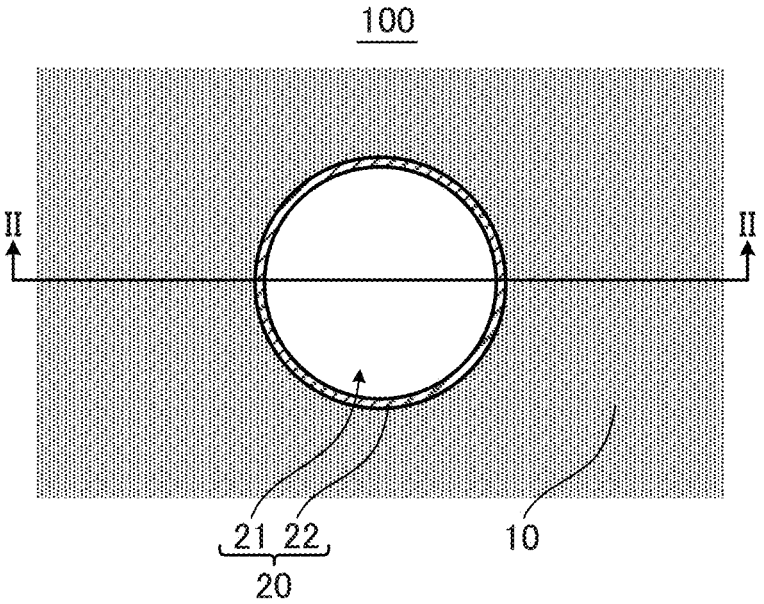
FIG. 1 schematically shows one example of a planar shape of a burring structural member.
Figure 2:
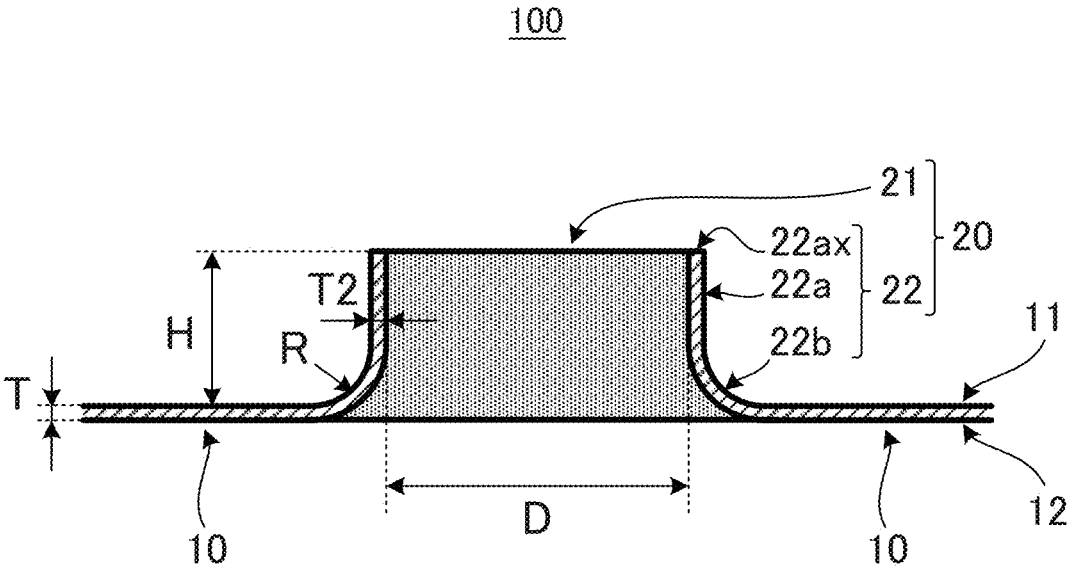
FIG. 2 schematically shows one example of the cross-sectional shape of a burring structural member and the shape of an II-II arrow cross-section in FIG. 1.

As shown in FIGS. 1 and 2, the burring structural member 100 according to one embodiment has

- a burring hole 21,
- a burring wall part 22 provided around the burring hole 21 and having a vertical wall part 22*a* and a bent wall part 22*b* connected to the vertical wall part 22*a*, and
- a sheet-shaped part 10 provided around the burring wall part 22 and connected to the bent wall part 22*b*.

Below, the burring hole 21 and burring wall part 22 will sometimes be referred to all together as the "burring structural part 20".

In the burring structural member 100, a thickness T of the sheet-shaped part 10 is 2.0 mm or more. A Charpy impact value vE(0) of the sheet-shaped part 10 at 0° C. is 50 J/cm$^2$ or more. A BCI value calculated by the following formula (1) based on the Charpy impact value vE(0) and a maximum length Lc of a crack at the inside bend of the bent wall part 22*b* is 2.5 or more. A curvature radius R of the inside bend of the bent wall part 22*b* is larger than R1 calculated by the following formula (2):

$$BCI = vE(0)/Lc \quad (1)$$

$$R1 = 25/BCI - 1.5 \quad (2)$$

where, the unit of vE(0) is J/cm$^2$, the unit of Lc is μm, and the unit of R1 is mm.

1. Sheet-Shaped Part

As shown in FIGS. 1 and 2, the sheet-shaped part 10 has a first surface 11 at one side and has a second surface 12 at an opposite side to the first surface 11. The burring wall part 22 projects out from the first surface 11 of the sheet-shaped part 10 to one side.

1.1 Planar Shape

As shown in FIGS. 1 and 2, the sheet-shaped part 10 is provided around the burring wall part 22 and is connected to a later explained bent wall part 22*b*. In the burring structural member 100, the sheet-shaped part 10 may be present in a slight amount. The shape of the outer edge of the sheet-shaped part 10 (planar shape of burring structural member 100 as a whole) is not particularly limited and may be suitably determined in accordance with the application of the burring structural member 100. The sheet-shaped part 10 does not have to be completely flat in shape and for example may have relief shapes, curves, notches, etc. in part. If the curvature radius is sufficiently larger than the curvature radius of the bent wall part (for example, 10 times or more, 25 times or more, 50 times or more, or 100 times or more), the shape may be one gently curved as a whole.

1.2 Thickness

As shown in FIG. 2, the sheet-shaped part 10 has a thickness T. The thickness T is 2.0 mm or more. So far as the inventors checked, in conventional burring structural members, the problem of fracture when the burring wall part is bent back or compressed easily occurs when the thickness of the sheet-shaped part is 2.0 mm or more. On this point, the burring structural member 100 of the present disclosure can be said to solve the unique problem when the thickness T of the sheet-shaped part 10 is 2.0 mm or more. On the other hand, if the thickness T is too great, when burring is performed, large cracks easily form at the inside bend and the curvature radius R of the bent wall part 22*b* is liable to become R1 or less calculated by the above formula (2). Further, inherently burring is liable to become difficult. In accordance with need, the thickness T may be 2.2 mm or more, 2.4 mm or more, 2.8 mm or more, 3.0 mm or more, or 3.4 mm or more and may be 8.0 mm or less, 7.0 mm or less, 6.0 mm or less, 5.0 mm or less, or 4.0 mm or less. In accordance with need, the thickness T of the sheet-shaped part 10 may be 2.0 mm or more and 8.0 mm or less. The thickness T may be the same in the sheet-shaped part 10 as a whole or may be different depending on the portion of the sheet-shaped part 10.

1.3 Charpy Impact Value vE(0) at 0° C.

The Charpy impact value vE(0)) of the sheet-shaped part 10 at 0° C. is 50 J/cm$^2$ or more. If the vE(0) of the sheet-shaped part is too small, at the time of burring, work hardening becomes remarkable at the bent wall part 22*b*. Due to the effect of work hardening, fracture easily occurs at the time of bending back or compressing the burring wall part 22. If vE(0) is 50 J/cm$^2$ or more, such a problem hardly ever occurs. In accordance with need, vE(0) may be 60 J/cm$^2$ or more, 70) J/cm$^2$ or more, or 80 J/cm$^2$ or more. The upper limit of vE(0) is not particularly prescribed, but in accordance with need may be 300 J/cm$^2$ or less, 250 J/cm$^2$ or less, 200 J/cm$^2$ or less, 160 J/cm$^2$ or less, or 140 J/cm$^2$ or less. In accordance with need, vE(0) may also be limited to a certain specific range (specific range with upper limit and lower limit). The lower limit and upper limit in this case may be any combination of said lower limit and upper limit. For example, vE(0) may be 50 J/cm$^2$ or more and 200 J/cm$^2$ or less, 50 J/cm$^2$ or more and 180 J/cm$^2$ or less, 50 J/cm$^2$ or more and 160 J/cm$^2$ or less, or 50 J/cm$^2$ or more and 140 J/cm$^2$ or less. Further, the Charpy impact value vE(0) of the sheet-shaped part 10 at 0° C. is found by subjecting a V-notch test piece of a subsize of 2.5 mm taken from the sheet-shaped part 10 to a Charpy impact test based on JIS Z 2242:2018. If the thickness is less than 2.5 mm, the test may be conducted for the entire thickness.

1.4 Tensile Strength TS

According to findings of the inventors, along with the higher strength of materials, cracks more easily form at the inside bend of the bent wall part 22*b*. That is, the problem of fracture when the burring wall part 22 is bent back or compressed occurs particularly easier in high strength steel sheet. On this point, the tensile strength TS of the sheet-shaped part 10 may be 780 MPa or more, 800 MPa or more, 850 MPa or more, 900 MPa or more, 950 MPa or more, 980) MPa or more, 1000 MPa or more, 1050 MPa or more, 1100 MPa or more, 1150 MPa or more, 1180 MPa or more, 1200 MPa or more, 1250) MPa or more, 1300 MPa or more, 1350 MPa or more, 1400 MPa or more, 1450) MPa or more, or 1470 MPa or more. The upper limit of the tensile strength of the sheet-shaped part 10 is not particularly prescribed, but for example may be 2500 MPa or less, 2200 MPa or less, 2000 MPa or less, 1800 MPa or less, 1500 MPa or less, 1300 MPa or less, or 1180 MPa or less. In accordance with need, the tensile strength TS of the sheet-shaped part 10) may be limited to a certain specific range (specific range with lower limit and upper limit). The lower limit and upper limit in this case may be any combination of said lower limit and upper limit. For example, the tensile strength TS of the sheet-shaped part 10 may be 780 MPa or more and 2500 MPa or less or may be 980 MPa or more and 2500 MPa or less. The "tensile strength" of the sheet-shaped part referred to in the present application may be one based on JIS Z 2241:2011.

2. Burring Structural Parts

As shown in FIGS. 1 and 2, the burring structural parts 20 have a burring hole 21 and a burring wall part 22.

2.1. Burring Hole

As shown in FIGS. 1 and 2, the burring hole 21 is a hole running through one side and the other side of the burring structural parts 20. As shown in FIG. 1, the planar shape of the burring hole 21 (opening shape) is circular. "Circular" does not have to be a perfect circle. There may be a certain extent of error allowable in industrial production. For example, if the length of the straight line running from one point on the outer edge of the open shape of the burring hole 21, passing through the center of that open shape, and connecting to another point on the outer edge is deemed the "diameter" of the burring hole 21, the case where the ratio of the maximum diameter to the minimum diameter is 1.00 or more and 1.10 or less can be deemed "circular".

The size of the burring hole 21 is not particularly limited and may be determined in accordance with the application of the burring structural member 100. The burring hole 21 may have an open shape comprised of a circle of a diameter D. The diameter D of the burring hole 21 may, for example, be 5.0 mm or more, 10.0 mm or more, 20.0 mm or more, 30.0 mm or more, 40.0 mm or more, 50.0 mm or more, 60.0 mm or more, 70.0 mm or more, 80.0 mm or more, or 90.0 mm or more and may be 500 mm or less, 300 mm or less, 100 mm or less, 90.0 mm or less. 80.0 mm or less, 70.0 mm or less, 60.0 mm or less, 50.0 mm or less, 40.0 mm or less, 30.0 mm or less, 20.0 mm or less, or 10.0 mm or less. In accordance with need, the diameter D may also be limited to a certain specific range (a specific range having a lower limit and upper limit). The lower limit and upper limit in this case may be any combination of said lower limit and upper limit. For example, the diameter D may also be 5.0 mm or more and 500 mm or less. Further, the diameter D of the burring hole 21 may be 5 times or more or 10 times or more of the above thickness T and may be 100 times or less or 50 times or less of it. For example, diameter D of the burring hole 21 may also be 5 times or more and 100 times or less of the above thickness T.

2.2 Burring Wall Part

As shown in FIGS. 1 and 2, the burring wall part 22 is provided around the burring hole 21. In other words, the open shape of the burring hole 21 is defined by the inside wall of the burring wall part 22. As shown in FIGS. 1 and 2, the burring wall part 22 may have a cylindrically shaped part. Further, as shown in FIG. 2, the burring wall part 22 projects out to one side from the first surface 11 of the sheet-shaped part 10. The projecting direction of the burring wall part 22 is a direction intersecting the planar direction of the sheet-shaped part 10, for example, may be a direction perpendicular to the planar direction of the sheet-shaped part 10. Further, as shown in FIG. 2, the burring wall part 22 has a vertical wall part 22*a* and a bent wall part 22*b*.

2.2.1 Vertical Wall Part

As shown in FIG. 2, the vertical wall part 22*a*, for example, has a tubular shape. It has a burring end face 22*ax* at one side and is connected to the bent wall part 22*b* at the opposite side to the one side.

2.2.1.1 Orientation of Vertical Wall Part

The vertical wall part 22*a* may have a surface running along the punching direction at the time of the burring. For example, as shown in FIG. 2, in the cross-sectional shape running along the center axis of the burring hole 21, the inside wall surfaces of the vertical wall part 22*a* facing each other may be parallel with each other. Further, as shown in FIG. 2, the orientation of the outer wall surface of the vertical wall part 22*a* and the orientation of the first surface 11 of the sheet-shaped part 10 may intersect each other, for example, may be perpendicular with each other.

2.2.1.2 Height

As shown in FIG. 2, the burring wall part 22 may have a predetermined height H from the first surface 11 to the burring end face 22*ax* of the vertical wall part 22*a*. The height H, for example, may be 5 mm or more, 10 mm or more, 20 mm or more, 30 mm or more, 40 mm or more, or 50 mm or more and may be 500 mm or less, 400 mm or less, 300 mm or less, 200 mm or less, or 100 mm or less. In accordance with need, the height H may be restricted to a certain specific range (a specific range having a lower limit and upper limit). The lower limit and the upper limit in this case may be any combination of said lower limit and upper limit. For example, the height H may be 5 mm or more and 500 mm or less. Alternatively, the height H may also be, for example, 2 times or more, 5 times or more, 8 times or more, or 10 times or more of the thickness T of the sheet-shaped part 10, and may be 200 times or less, 150 times or less, 100 times or less, or 50 times or less of the thickness T of the sheet-shaped part 10. For example, the height H may also be 2 times or more and 200 times or less of the thickness T of the sheet-shaped part 10.

2.2.2 Bent Wall Part

As shown in FIG. 2, the bent wall part 22*b*, for example, is provided around the vertical wall part 22*a* in a ring shape and connects the vertical wall part 22*a* and the sheet-shaped part 10. More specifically, the bent wall part 22*b* is connected at one side to the vertical wall part 22*a* and is connected to the sheet-shaped part 10 at the opposite side to that one side. The bent wall part 22*b* has a curvature radius R while connects the sheet-shaped part 10 and the vertical wall part 22*a*. For example, there is no break among the first surface 11 of the sheet-shaped part 10, the outside wall surface of the bent wall part 22*b*, and the outside wall surface of the vertical wall part 22*a*.

2.2.2.1 Length of Cracks at Inside Bend

Figure 3:
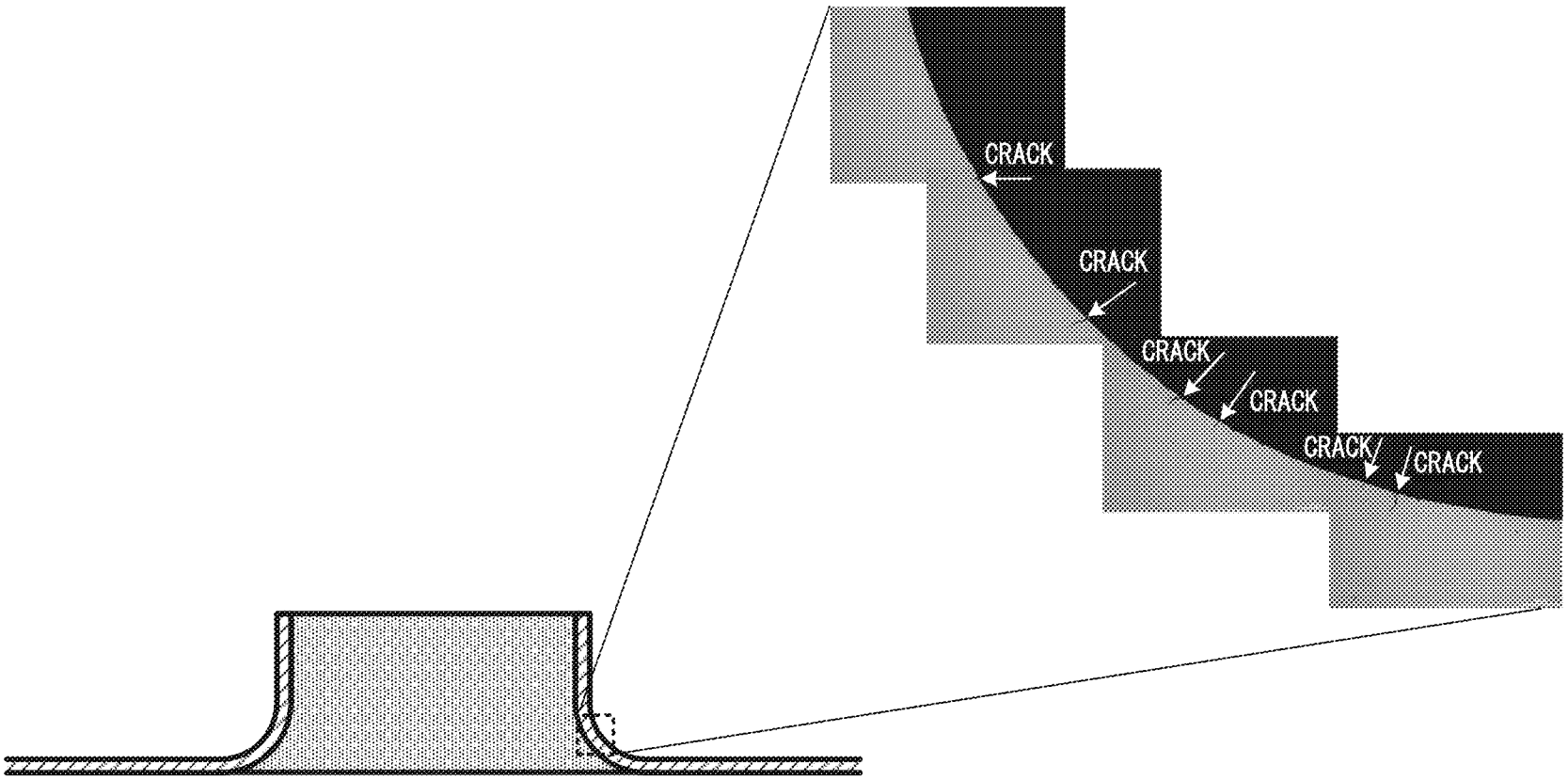
FIG. 3 shows one example of a form of a crack of an inside bend of a bent wall part.

As shown in FIG. 3, cracks (fissures) easily occur at the inside bend of the bent wall part 22*b*. According to the findings of the inventors, if a crack at the inside bend of the bent wall part 22*b* is too long (too deep), the later explained BCI value is liable to become excessively small and the R1 value is liable to become excessively large. On this point, in the burring structural member 100 of the present disclosure, the crack length is preferably kept to one where the BCI value and R1 value become predetermined ranges. The maximum length Lc of an inside bend crack of the bent wall part 22*b* is preferably short, for example, is preferably 50 μm or less. The maximum length Lc may also be 0 μm (no crack), but obtaining completely zero cracks may be difficult. The maximum length Lc may be 0 μm or more and 50 μm or less, may be more than 0 μm, 1 μm or more, 3 μm or more, 5 μm or more, 7 μm or more, or 10 μm or more, and may be 45 μm or less, 40 μm or less. 35 μm or less, or 30 μm or less.

The maximum length Lc of a crack at the inside bend of the bent wall part 22*b* is identified by examining a cross-section of the burring structural parts 20. The cross-section of the burring structural parts 20 can be acquired, for example, by electrodischarge machining (for example, wire cutting). The examined cross-section covers the entirety of the inside bend of the bent wall part 22*b*. In examining the entirety of the inside bend, several images may be acquired.

The examined field for each of the several images may be made 50 μm×50 μm. Cross-sections obtained by dividing the same burring structural parts 20 into eight equal parts in the plan view are examined for the entirety of the inside bend, the maximum lengths of cracks at the inside bend at the different cross-sections are identified, and the longest among these is specified as the maximum length Lc. Further, in the present application, the length of a crack at the inside bend of the bent wall part 22*b* means the shortest distance from the front end of that crack (front end at deepest position from surface of bent wall part 22*b*) to the surface of the inside bend of the bent wall part 22*b*.

2.2.2.2 Curvature Radius

As shown in FIG. 2, the bent wall part 22*b* has a curvature radius R at the inside bend. The curvature radius R of the bent wall part 22*b* need be larger than the R1 calculated by the later explained formula (2). The curvature radius R of the bent wall part 22*b* may, for example, be 0.5 mm or more and 10.0 mm or less. The curvature radius R may be 1.0 mm or more, 2.0 mm or more, or 3.0 mm or more and may be 8.0 mm or less, 6.0 mm or less, or 5.0 mm or less.

Figure 4:
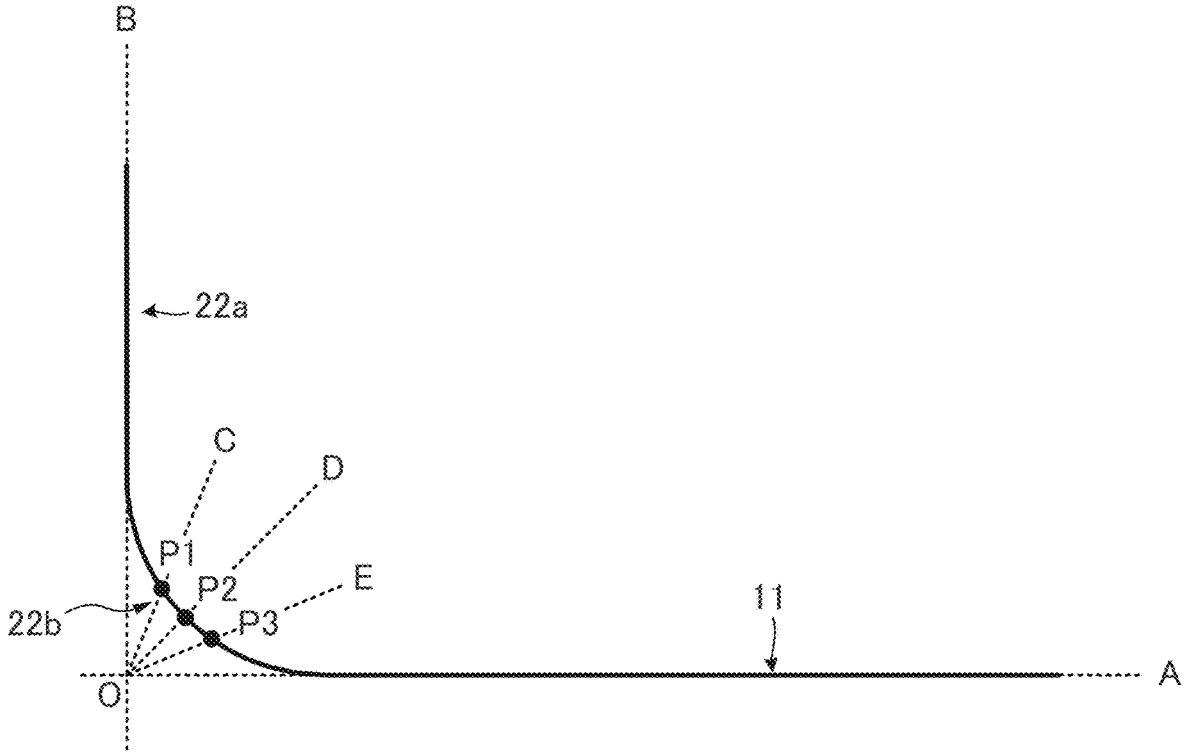
FIG. 4 shows a method of specification of a curvature radius of a bent wall part.

As shown in FIG. 4, the curvature radius R of the bent wall part 22*b* can be identified based on the cross-sectional shape of the burring structural member 100 running along the center axis of the burring hole 21 (shape of cross-section including center axis). That is, as shown in FIG. 4, in that cross-sectional shape, a line A is drawn along the first surface 11 of the sheet-shaped part 10 (in the first surface 11, part deemed flat near bent wall part 22*b*) and a line B is drawn along an outside wall surface of the vertical wall part 22*a* (surface, in outer wall surface, running along direction of projection at time of burring). The intersecting point O of the line A and the line B is identified. From the intersecting point O, three lines C, D, and E dividing the angle AOB into four equal parts are drawn. The intersecting point P1 of the line C and the outside wall surface of the bent wall part 22*b*, the intersecting point P2 of the line D and the outside wall surface of the bent wall part 22*b*, and the intersecting point P3 of the line E and the outside wall surface of the bent wall part 22*b* are identified. The single circle running through these three intersecting points P1, P2, and P3 is identified, and the radius of that circle is deemed the curvature radius R of the bent wall part 22*b*. Note that, when identifying the curvature radius R, the presence of any cracks at the inside bend is ignored, that is, the curvature radius R may be identified deeming no cracks exist.

2.2.3 Thickness of Burring Wall Part

As shown in FIG. 2, the burring wall part 22 may have the thickness T2. The thickness T2 may be suitably determined in accordance with the targeted strength etc. The thickness T2 may be 1.8 mm or more, 2.0 mm or more, 2.2 mm or more, 2.6 mm or more, 2.8 mm or more, or 3.2 mm or more and may be 10.0 mm or less, 8.0 mm or less, 6.0 mm or less, 5.0 mm or less, or 4.0 mm or less. The thickness T2 is, for example, 1.8 mm or more and 10.0 mm or less. The thickness T2 may be approximately the same in the burring wall part 22 as a whole or may differ for each portion of the burring wall part 22. The thickness T2 may be greater than or less than the thickness T of the sheet-shaped part 10, but due to the nature of burring, it easily becomes thinner than the thickness T. Specifically, the ratio T2/T of the thickness T2 and the thickness T may be 0.5 or more, 0.6 or more, or 0.7 or more and may be 1.2 or less, 1.1 or less, or 1.0 or less. The ratio T2/T of the thickness T2 and the thickness T may, for example, be 0.5 or more and 1.2 or less.

2.3 BCI Value

In the burring structural member 100 of the present disclosure, the BCI value calculated by the following formula (1) is 2.5 or more. If the BCI value is too small, the effect of the crack length on the toughness would become great and even if specially modifying the shape etc. of the burring structural parts 20, fracture would easily occur upon being bent back or compressed. The upper limit of the BCI value is not particularly prescribed. The BCI value may, for example, be 2.5 or more and 30.0 or less. The BCI value may be 3.0 or more, 4.0 or more, or 5.0 or more and may be 28.0 or less, 26.0 or less, 24.0 or less, 22.0 or less, 20.0 or less, 18.0 or less, 16.0 or less, 14.0 or less, 12.0 or less, or 10.0 or less. Note that, in the present application, formula (1) is an empirical formula. The unit of the denominator Lc when the BCI value is calculated is μm, the unit of the numerator vE(0) is J/cm$^2$, and the unit of the BCI value calculated by the following formula (1) is J/(cm$^2$·μm).

$$BCI = vE(0)/Lc \tag{1}$$

2.4 Relationship of Curvature Radius R and R1 Calculated by Formula (2)

In the burring structural member 100 of the present disclosure, the curvature radius R of the inside bend of the bent wall part 22*b* is larger than the R1 calculated by the following formula (2). Note that formula (2) is an empirical formula. In formula (2), the units do not match at the left side and right side. The unit of R1 at the left side is mm, while the unit of the BCI value entered at the right side is, as explained above, J/(cm$^2$·μm). In calculating R1, the units are not particularly converted. That is, the value obtained by directly entering the BCI value calculated by the above formula (1) into formula (2) is R1 (mm). According to findings of the inventors, if the requirements relating to the above-mentioned thickness T, above-mentioned Charpy impact value vE(0), and above-mentioned BCI value are satisfied and the curvature radius R is greater than R1, fracture becomes harder to occur when bending back or compressing the burring structural parts 20 regardless of the material, strength, etc. of the burring structural member 100.

$$R1 = 25/BCI - 1.5 \tag{2}$$

3. Material of Burring Structural Member

The burring structural member 100 is self evidently made of metal. The burring structural member 100 may, for example, be comprised of a steel material. In this case, the chemical composition and microstructure of the steel material are not particularly limited and may be suitably determined in accordance with the application of the burring structural member 100. According to the art of the present disclosure, it is possible to improve the fracture resistance at the time of bending back or compressing the burring structural parts 20 in burring structural members 100 having various chemical compositions and microstructures. As one example of the chemical composition, the chemical composition of the steel forming the burring structural member 100 may be, by mass %, C: 0.01 to 1.0%, Si: 0.01 to 3.50%, Mn: 0.10 to 5.00%, P: 0.100% or less, S: 0.0300% or less, N: 0.0100% or less, O: 0 to 0.020%, Al: 0 to 1.000% or less, Cr: 0 to 2.00%, Cu: 0 to 2.00%, Ni: 0 to 2.00%, Mo: 0 to 3.00%, Co: 0 to 3.00%, Nb: 0 to 0.150%, V: 0 to 1.00%, Ti: 0 to 1.00%, W: 0 to 1.00%, Sn: 0 to 1.00%, Sb: 0 to 0.50%, Ta: 0 to 0.10%, As: 0 to 0.050%, B: 0 to 0.0100%, Ca: 0 to 0.100%, Mg: 0 to 0.100%, Zr: 0 to 0.100%, Hf: 0 to 0.100%, REM: 0 to 0.0050%, and a balance of Fe and impurities. Further, in the above chemical composition, the lower limit of the content of optionally added elements may be 0.0001% or 0.001%.

4. Number and Positions of Burring Structural Parts

In the burring structural member 100, the number of burring structural parts 20 is not limited to one. The burring structural member 100 may have a plurality of burring structural parts 20. Further, in addition to the burring structural parts 20, the burring structural member 100 may be further provided with other burring structural parts projecting out from the first surface 11 at one side (projecting out in same direction as burring wall part 22) and may be further provided with other burring structural parts projecting out from the second surface 12 at the other side (projecting out in opposite direction from burring wall part 22). The positions of the burring structural parts 20 at the burring structural member 100 are not particularly limited and may be suitably determined in accordance with the application of the burring structural member 100.

5. Applications of Burring Structural Member

As explained above, the burring structural member 100 of the present disclosure is resistant to fracture of the burring wall part 22 when the burring wall part 22 is bent back or is compressed and has excellent durability. On this point, the burring structural member 100 of the present disclosure can be applied in harsh environments in which great external force is applied. For example, the burring structural member 100 of the present disclosure may be used as an undercarriage part of an automobile. As specific examples of an undercarriage part of an automobile, a lower arm or upper arm or trailing link may be mentioned.

6. Method of Production of Burring Structural Member

Figure 5:
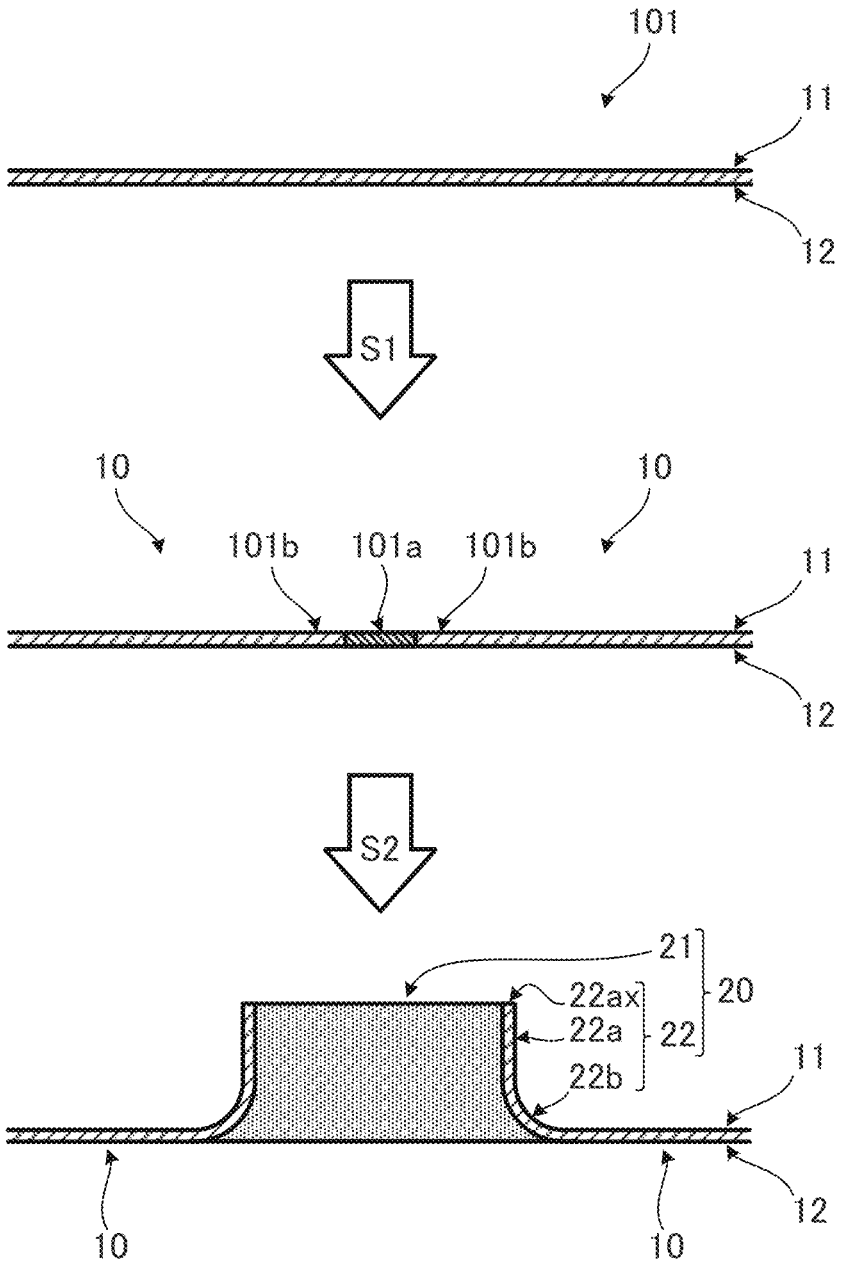
FIG. 5 shows one example of a flow of a method of production of a burring structural member.

The burring structural member 100 of the present disclosure can be produced by processing a part of the metal sheet of the material being worked for burring. For example, as shown in FIG. 5, the method of production of the burring structural member 100 is provided with the following S1 and S2. Further, the method of production of the burring structural member 100 may be provided with one or both of the following S3 and S4 in addition to the following S1 and S2. That is, the burring structural member 100 can be produced by any one of the three methods of: (1) a method including S1, S2, and S3; 2) a method including S1, S2, and S4; and 3) a method including S1, S2, S3, and S4.

S1: Providing a punched hole 101*a* at part of a metal sheet 101. Here, the metal sheet 101 has a first surface 11 at one side and a second surface 12 at an opposite side to the first surface 11. A sheet-shaped part 10 is present around the punched hole 101*a*. The thickness T of the sheet-shaped part 10 is 2.0 mm or more, and a Charpy impact value vE(0) of the sheet-shaped part 10 at 0° C. is 50 J/cm$^2$ or more.

S2: Raising a peripheral edge 101*b* of the punched hole 101*a* from the first surface 11 to one side to thereby provide the burring structural part 20. Here, the burring structural part 20 includes a burring hole 21 and a burring wall part 22. The burring wall part 22 is provided around the burring hole 21. The burring wall part 22 has a vertical wall part 22*a* and a bent wall part 22*b*. The bent wall part 22*b* connects the vertical wall part 22*a* and the sheet-shaped part 10.

S3: Before S2, adjusting in advance the extent of contact of the worked member (metal sheet 101) and die at the time of burring in the step of S2 so that both of the following requirements (A) and (B) are satisfied.

S4: Polishing or grinding the surface of the inside bend of the bent wall part 22*b* after the burring so that both of the following requirements (A) and (B) are satisfied. Note that, in this case, a burring structural member produced by the same burring method in advance is measured for the maximum length Lc of a crack at the inside bend of the bent wall part 22*b* by the above-mentioned method, then the target polished thickness (or target ground thickness) of the inside bend of the bent wall part 22*b* is determined. After that, it is preferable to measure the thickness of the bent wall part 22*b* while polishing (or grinding) so as to reliably polish (or grind) to obtain the target polished thickness (or ground thickness).

(A) a BCI value calculated by the following formula (1) based on the Charpy impact value vE(0) and a maximum length Lc of a crack at the inside bend of the bent wall part 22*b* becomes 2.5 or more.

(B) a curvature radius R of the inside bend of the bent wall part 22*b* is larger than R1 calculated by the following formula (2):

$$BCI = vE(0)/Lc \quad (1)$$

$$R1 = 25/BCI - 1.5 \quad (2)$$

where, the unit of vE(0) is J/cm$^2$, the unit of Lc is μm, and the unit of R1 is mm.

S1 and S2 may be performed using a punch or die. Here, the length of a crack at the inside bend formed at the bent wall part 22*b* of the burring structural part 20 can change due to the material or surface properties of the part forming the bent wall part 22*b*, the burring conditions (degree of decrease of thickness), etc. The inventors investigated Lc by the above method for numerous burring structural members with tensile strengths of the sheet-shaped parts of 780 MPa or more. As a result, satisfaction of the above formulas (1) and (2) could not be confirmed. On this point, to obtain a burring structural member satisfying the above formulas (1) and (2), special modification becomes required in the production process. For example, a burring structural member satisfying the above formulas (1) and (2) is obtained by performing one or both of the above S3 and S4.

In S3, the extent of contact of the worked member (metal sheet 101) and die at the time of burring is adjusted in advance before S2 so that both of the above requirements (A) and (B) are satisfied. For example, at the time of processing for burring, the part forming the inside bend of the bent wall part 22*b* may be adjusted so as not to contact the die as much as possible. Further, the part forming the vertical wall part 22*a* may contact the die. By specially modifying the processing conditions at the time of such burring processing as well, it is possible to obtain a burring structural member satisfying the above formulas (1) and (2).

In S4, the inside bend surface of the bent wall part 22*b* after the processing for burring is polished or ground so that both of the above requirements (A) and (B) are satisfied. For example, sandpaper or a grinder etc. may be used to polish or grind the inside bend surface of the bent wall part 22*b*. In the past, such polishing and/or grinding had not been performed. By polishing or grinding the inside bend surface of the bent wall part 22*b*, it is possible to reduce or remove cracks at the inside bend and possible to obtain a burring structural member satisfying the above formulas (1) and (2).

Further, the method of production of the present disclosure may be provided with the following S5:

S5: Before S2, reducing the surface roughness of the surface at least at the part becoming the bent wall part 22*b* in the surface of the metal sheet 101.

According to the findings of the inventors, by reducing the surface roughness of a metal sheet before S2, it is possible to decrease the length of a crack formed at the inside bend of the bent wall part 22*b* after burring processing. The method of reducing the surface roughness of a metal sheet at S5 is not particularly limited. For example, it is possible to polish the surface of a metal sheet. The polishing may be performed by employing a known method. For example, mechanical polishing using sandpaper etc. or chemical polishing etc. may be mentioned.

EXAMPLES

Below, examples will be shown while explaining the effects etc. of the art of the present disclosure in further detail, but the art of the present disclosure is not limited to the following examples.

1. Evaluation Using Sheet-Shaped Test Pieces

In the following examples, sheet-shaped test pieces were evaluated by bending and bending back. There were no substantive differences in the effects of cracks at the inside bends on bending back between the case of bending back the bent parts for sheet-shaped test pieces which have been bent and the case of bending back burring wall parts for sheet-shaped test pieces which have been burred, so the following examples can be said to have suitably simulated the phenomena which occur when bending back a burring wall part of a burring structural member, and it can be said that the performance of the burring structural parts of a burring structural member was suitably evaluated.

1.1 Evaluation Conditions and Evaluation Criteria 1.1.1 Evaluation 1 (Evaluation of Bending)

Figure 6A:
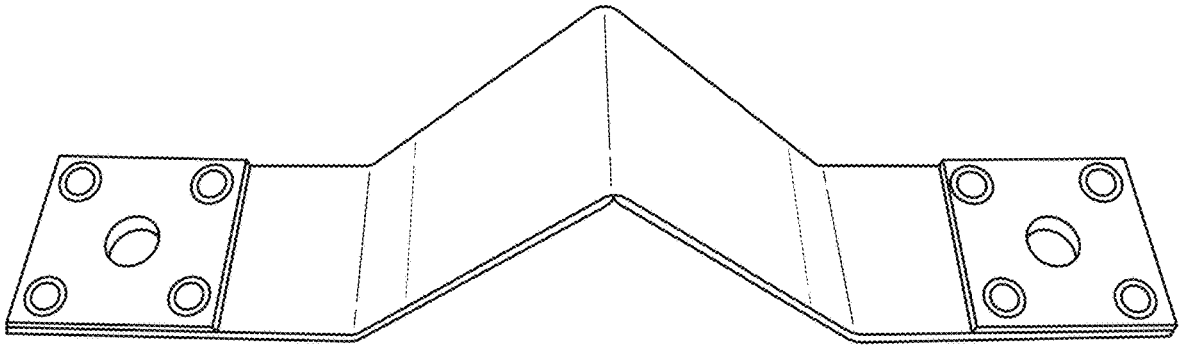
FIG. 6A shows a state of a test piece after bending.

As shown in FIG. 6A, test pieces with widths of 30 mm, lengths of 200 mm, and thicknesses of 2 mm were bent by predetermined curvature radii R under various processing conditions. The test pieces were prepared by cutting them out from the steel sheet A (tensile strength TS: 1005 MPa, Charpy impact value vE(0): 53.2 J/cm$^2$), steel sheet B (tensile strength TS: 992 MPa, Charpy impact value vE(0): 80.1 J/cm$^2$), steel sheet C (tensile strength TS: 983 MPa, Charpy impact value vE(0): 133.8 J/cm$^2$), steel sheet D (tensile strength TS: 785 MPa, Charpy impact value vE(0): 152.2 J/cm$^2$), steel sheet E (tensile strength TS: 1188 MPa, Charpy impact value vE(0): 64.1 J/cm$^2$), and steel sheet F (tensile strength TS: 1236 MPa, Charpy impact value vE(0): 36.7 J/cm$^2$). To simulate burring, the bending angle in the bending was made 90°. A cross-section of each test piece after the bending was examined and the maximum length Lc of a crack formed at the inside bend and the BCI value calculated by the following formula (1) were identified. Further, based on the BCI value, the R1 calculated by the following formula (2) was identified and whether the curvature radius R was larger than that R1 was judged.

$$BCI = vE(0)/Lc \tag{1}$$

$$R1 = 25/BCI - 1.5 \tag{2}$$

1.1.2 Evaluation 2 (Evaluation of Bend Back)

Figure 6B:
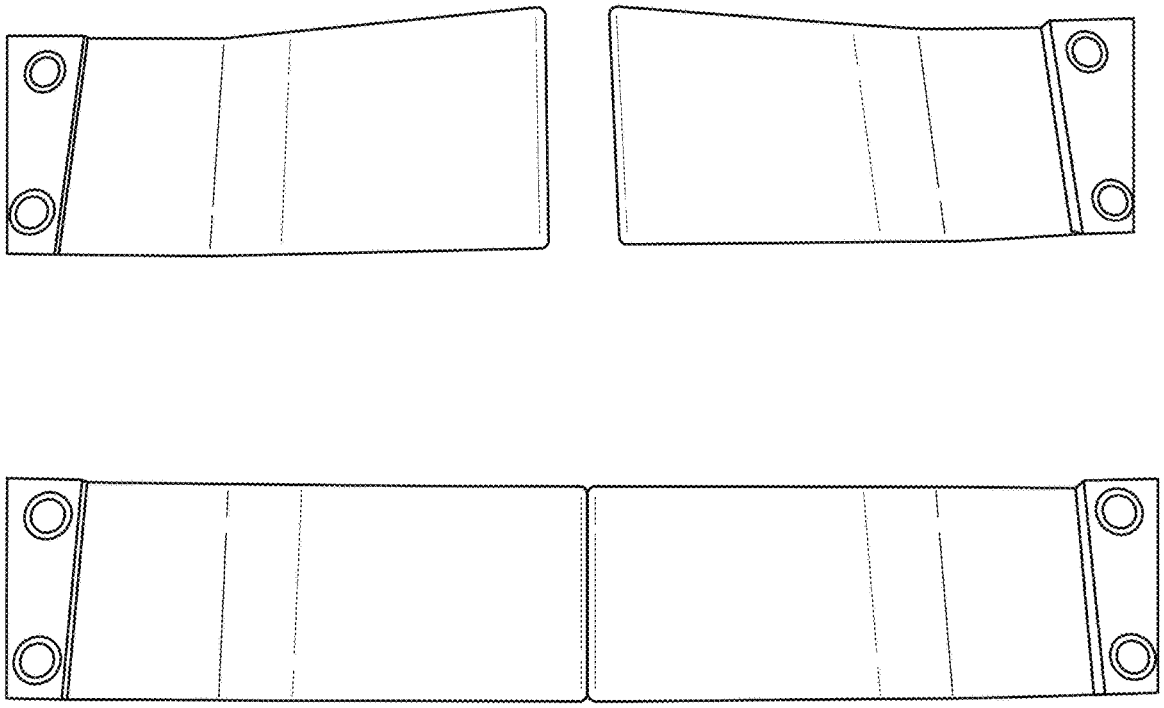
FIG. 6B shows a state of a test piece after being bent back.

Under the same conditions as the above bending, test pieces with widths of 30 mm, lengths of 200 mm, and thicknesses of 2 mm were bent by predetermined curvature radii R. That is, for each of the bending conditions the same as the test pieces for observation of the cross-section after bending, another test piece was prepared and used for the later explained bend back test. A bent test piece can be deemed to have a maximum length Lc and BCI value similar to those in the above Evaluation 1. A bent test piece was bent back by pulling the two ends of the test piece. The bend back operation was performed until the bending angle of the test piece became 180° (that is, until a flat state with no bending). A case like the upper side test piece of FIG. 6B where the test piece fractured before the bend back was completed was evaluated as "Fail" while a case like the lower side test piece where bend back was completed without fracturing was evaluated as "Pass".

1.2 Results of Evaluation

Figure 7:
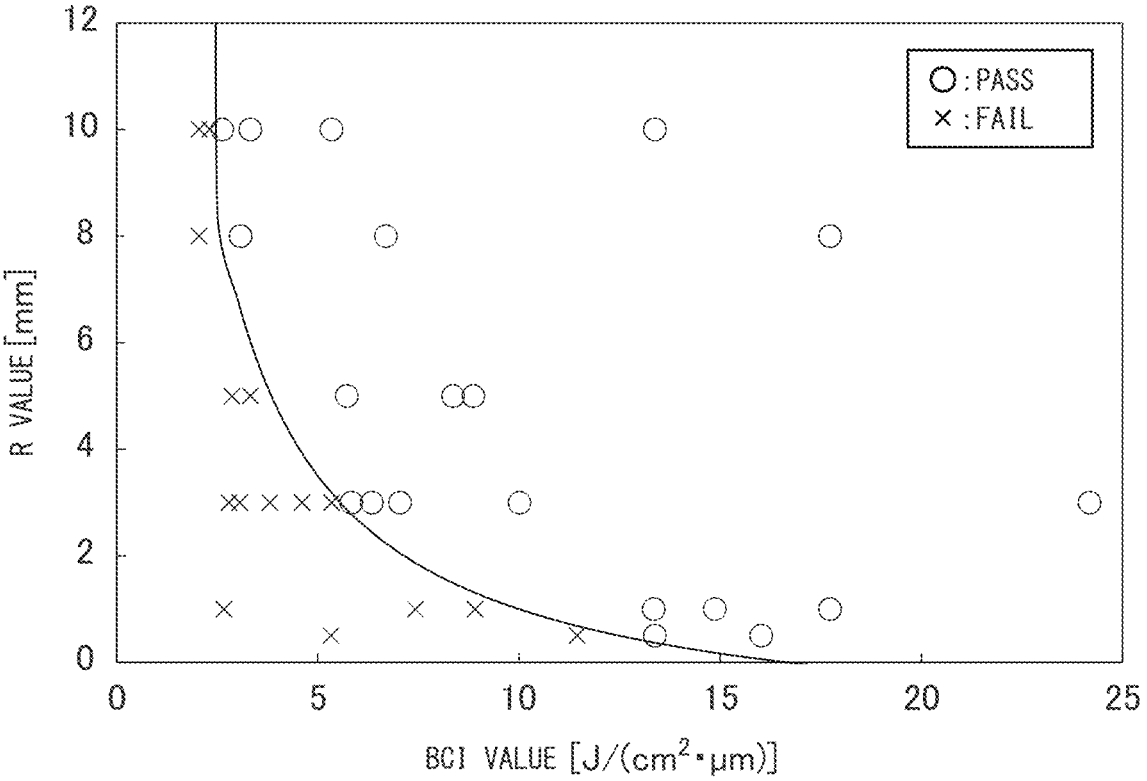
FIG. 7 shows the results of Examples. An abscissa shows a BCI value, while an ordinate shows the curvature radius R. "○" ("Pass") and "×" ("Fail") are plotted.

The following Table 1 shows the results of evaluation. Further, FIG. 7 shows a graph having the BCI value on the abscissa and the curvature radius R on the ordinate in which the pass and fail results are plotted for test pieces with a tensile strength of the 980 MPa class (taken from the steel sheets A to C).

TABLE 1

| Strength class | TS [MPa] | vE(0) [J/cm$^2$] | Lc [μm] | R [mm] | BCI value | R1 | Pass/fail |
|---|---|---|---|---|---|---|---|
| 980 MPa class | 1005 | 53.2 | 10 | 0.5 | 5.32 | 3.20 | Fail |
| | 1005 | 53.2 | 3 | 1.0 | 17.73 | −0.09 | Pass |
| | 1005 | 53.2 | 20 | 1.0 | 2.66 | 7.90 | Fail |
| | 1005 | 53.2 | 14 | 3.0 | 3.80 | 5.08 | Fail |
| | 1005 | 53.2 | 2 | 3.0 | 24.18 | −0.47 | Pass |
| | 1005 | 53.2 | 16 | 5.0 | 3.33 | 6.02 | Fail |
| | 1005 | 53.2 | 6 | 5.0 | 8.87 | 1.32 | Pass |
| | 1005 | 53.2 | 26 | 8.0 | 2.05 | 10.72 | Fail |
| | 1005 | 53.2 | 3 | 8.0 | 17.73 | −0.09 | Pass |
| | 1005 | 53.2 | 26 | 10.0 | 2.05 | 10.72 | Fail |
| | 1005 | 53.2 | 23 | 10.0 | 2.31 | 9.31 | Fail |
| | 1005 | 53.2 | 16 | 10.0 | 3.33 | 6.02 | Pass |
| | 992 | 80.1 | 5 | 0.5 | 16.02 | 0.06 | Pass |
| | 992 | 80.1 | 7 | 0.5 | 11.44 | 0.68 | Fail |
| | 992 | 80.1 | 6 | 1.0 | 13.35 | 0.37 | Pass |
| | 992 | 80.1 | 9 | 1.0 | 8.90 | 1.31 | Fail |
| | 992 | 80.1 | 8 | 3.0 | 10.01 | 1.00 | Pass |
| | 992 | 80.1 | 15 | 3.0 | 5.34 | 3.18 | Fail |
| | 992 | 80.1 | 14 | 5.0 | 5.72 | 2.87 | Pass |
| | 992 | 80.1 | 28 | 5.0 | 2.86 | 7.24 | Fail |

TABLE 1-continued

| Strength class | TS [MPa] | vE(0) [J/cm$^2$] | Lc [μm] | R [mm] | BCI value | R1 | Pass/ fail |
|---|---|---|---|---|---|---|---|
| | 992 | 80.1 | 26 | 8.0 | 3.08 | 6.61 | Pass |
| | 992 | 80.1 | 15 | 10.0 | 5.34 | 3.18 | Pass |
| | 983 | 133.8 | 10 | 0.5 | 13.38 | 0.37 | Pass |
| | 983 | 133.8 | 9 | 1.0 | 14.87 | 0.18 | Pass |
| | 983 | 133.8 | 18 | 1.0 | 7.43 | 1.86 | Fail |
| | 983 | 133.8 | 19 | 3.0 | 7.04 | 2.05 | Pass |
| | 983 | 133.8 | 48 | 3.0 | 2.79 | 7.47 | Fail |
| | 983 | 133.8 | 16 | 5.0 | 8.36 | 1.49 | Pass |
| | 983 | 133.8 | 20 | 8.0 | 6.69 | 2.24 | Pass |
| | 983 | 133.8 | 10 | 10.0 | 13.38 | 0.37 | Pass |
| | 983 | 133.8 | 51 | 10.0 | 2.62 | 8.03 | Pass |
| 780 MPa class | 785 | 152.2 | 24 | 3.0 | 6.34 | 2.44 | Pass |
| | 785 | 152.2 | 33 | 3.0 | 4.61 | 3.92 | Fail |
| 1180 MPa class | 1188 | 64.1 | 11 | 3.0 | 5.83 | 2.79 | Pass |
| | 1188 | 64.1 | 21 | 3.0 | 3.05 | 6.69 | Fail |
| | 1236 | 36.7 | 9 | 5.0 | 4.08 | 4.63 | Fail |

Further, in the above examples, the cases where test pieces with thicknesses of 2.0 mm were evaluated were illustrated, but similar effects are confirmed even in cases of thicknesses of more than 2.0 mm. On the other hand, if the thickness is below 2.0 mm, regardless of vE(0), BCI, or R, fracture inherently tends to become difficult when the burring structural parts are bent back, and the effect due to control of vE(0), BCI, or R is small.

2. Fabrication of Burring Structural Members

Figure 8:
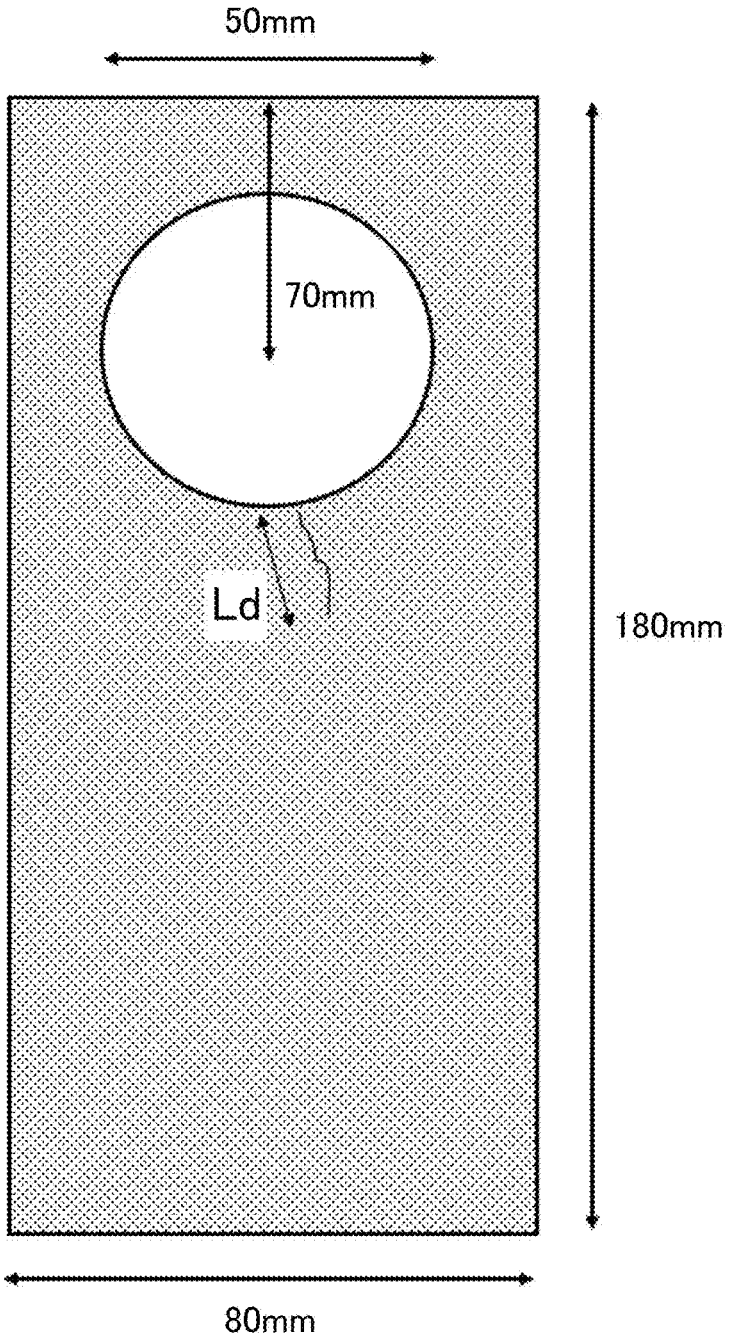
FIG. 8 shows the evaluation conditions of burring structural members in the Examples.

Steel sheets C to E having widths of 80 mm, lengths of 180 mm, and thicknesses of 2.3 mm were provided with punched holes. Here, the tensile strength TS of the steel sheet C was 983 MPa and the Charpy impact value vE(0) was 133.8 J/cm$^2$, the tensile strength TS of the steel sheet D was 785 MPa and the Charpy impact value vE(0) was 152.2 J/cm$^2$, and the tensile strength TS of the steel sheet E was 1188 MPa and the Charpy impact value vE(0) was 64.1 J/cm$^2$. The punched holes were made ones having centers at positions at the centers in the width directions of the steel sheets and positions 70 mm from ends in the length directions. The steel sheets were placed at the dies, then holes were punched out by a punch and the peripheral edges of the punched holes were raised to one side to thereby obtain burring structural members having burring holes and burring wall parts. FIG. 8 shows the shape of the burring structural member in a plan view. As shown in FIG. 8, the diameter D of the burring hole was made 50 mm. Further, the height H of the burring wall part was made 15 mm, and the thickness T2 of the burring wall part was made 2.0 mm. Further, the curvature radius R of the inside bend of the bent wall part of the burring wall part was made 1.0 mm for the steel sheet D and 2.0 mm for the steel sheets C and E.

2.1 Comparative Examples 1-1, 2-1, 2-2, and 3-1

Each of the steel sheets C to E was processed for burring, then evaluated as follows as is without any particular polishing after the burring process. Further, Comparative Example 2-1 and Comparative Example 2-2 are similar except for the difference in state of contact between the steel sheet and die at the time of the burring process.

2.2 Examples 1-1, 2-1, 2-3, and 3-1

Each of the steel sheets C to E was processed for burring. At that time, the states of contact between the steel sheets and dies were changed from Comparative Example 1-1, 2-1, 2-2, and 3-1 (specifically, control is performed so that parts of bent wall parts forming the inside bends do not contact as much as possible). No polishing was performed after the burring.

2.3. Examples 1-2, 2-2, and 3-2

Each of the steel sheets C to E was processed for burring in the same way as Comparative Examples 1-1, 2-1, and 3-1. After the burring process, the inside bend surfaces of the bent wall parts were polished by sandpaper. Specifically, a burring structural member produced by the same burring method in advance was measured for the maximum length Lc of a crack at the inside bend of the bent wall part, then the target polished thickness of the inside bend of the bent wall part was determined. After that, the thickness of the bent wall part was measured while performing polishing so as to obtain the target polished thickness.

3. Evaluation of Burring Structural Member

Two of each of the burring structural members fabricated in the above way were prepared. One burring structural member of each was examined over the entire region of the inside bend using cross-sections dividing the burring structural part into eight equal parts in a plan view. The maximum length of a crack at the inside bend at each cross-section was identified and longest length among them was specified as the above maximum length Lc. The remaining one burring structural member of each was subjected to the following compressive load test. In the compressive load test, the temperature was held at 0° C. while applying a compressive stress to the projecting part of the burring in a direction vertical to the surface of the sheet-shaped part (in the case of FIG. 2, load applied to burring end face 22*ax* from top to bottom of FIG. 2) (stroke control: 100 mm/s or more). If after reaching the maximum load, then the load falling 20%, the crack of the inside bend of the burring bent wall part had advanced 10 mm or more to the sheet-shaped part side around the burring wall part (case where length Ld of crack shown in FIG. 8 is 10 mm or more), the burring wall part was evaluated as having fractured ("Fail").

4. Results of Evaluation

The following Table 2 summarizes the maximum lengths Lc of the burring structural members, the fabrication conditions, the results of evaluation, etc.

TABLE 2

| | Strength class | TS [MPa] | vE (0) [J/cm$^2$] | Control of contact of inside bend surface and die | Polishing of inside bend surface | Lc [μm] | R [mm] | BCI value | R1 | Pass/ fail |
|---|---|---|---|---|---|---|---|---|---|---|
| Comp. Ex. 1-1 | 780 MPa class | 785 | 152.2 | No | No | 70 | 1.0 | 2.17 | 10.00 | Fail |
| Ex. 1-1 | | 785 | 152.2 | Yes | No | 4 | 1.0 | 38.05 | −0.84 | Pass |
| Ex. 1-2 | | 785 | 152.2 | No | Yes | 1 | 1.0 | 152.20 | −1.34 | Pass |
| Comp. Ex. 2-1 | 980 MPa class | 983 | 133.8 | No | No | 165 | 2.0 | 0.81 | 29.33 | Fail |
| Comp. Ex. 2-2 | | 983 | 133.8 | No | No | 32 | 2.0 | 4.18 | 4.48 | Fail |
| Ex. 2-1 | | 983 | 133.8 | Yes | No | 12 | 2.0 | 11.15 | 0.74 | Pass |
| Ex. 2-2 | | 983 | 133.8 | No | Yes | 1 | 2.0 | 267.60 | −1.41 | Pass |
| Ex. 2-3 | | 983 | 133.8 | Yes | No | 26 | 4.0 | 5.15 | 3.36 | Pass |
| Comp. Ex. 3-1 | 1180 MPa class | 1188 | 64.1 | No | No | 36 | 2.0 | 1.78 | 12.54 | Fail |
| Ex. 3-1 | | 1188 | 64.1 | Yes | No | 5 | 2.0 | 12.82 | 0.45 | Pass |
| Ex. 3-2 | | 1188 | 64.1 | No | Yes | 1 | 2.0 | 64.10 | −1.11 | Pass |

From the results shown in Tables 1 and 2 and FIG. 7, it can be said that a burring structural member not satisfying even one of the following requirements (A) to (D) easily fractures at the burring wall part when the burring wall part is bent back or is compressed, while a burring structural member satisfying all of the following requirements (A) to (D) is resistant to fracture of the burring wall part even if the burring wall part is bent back or is compressed.

(A) a thickness T of the sheet-shaped part is 2.0 mm or more. 2 or more.

(B) a Charpy impact value vE(0) of the sheet-shaped part at 0° C. is 50 J/cm$^2$ or more.

(C) a BCI value calculated by the following formula (1) based on the Charpy impact value vE(0) and a maximum length Lc of a crack at the inside bend of the bent wall part is 2.5 or more.

(D) a curvature radius R of the inside bend of the bent wall part is larger than R1 calculated by the following formula (2).

$$BCI = vE(0)/Lc \quad (1)$$

$$R1 = 25/BCI - 1.5 \quad (2)$$

where, the unit of vE(0) is J/cm$^2$, the unit of Lc is μm, and the unit of R1 is mm.

REFERENCE SIGNS LIST

10. sheet-shaped part
- 11. first surface
- 12. second surface

20. burring structural parts
- 21. burring hole
- 22. burring wall part
  - 22*a*. vertical wall part
  - 22*ax*. burring end face
  - 22*b*. bent wall part

100. burring structural member
101. metal sheet
101*a*. punched hole
101*b*. peripheral edge of punched hole

The invention claimed is:

1. A burring structural member of high strength steel comprising:

a burring hole;

a burring wall part provided around the burring hole and having a vertical wall part and a bent wall part connected to the vertical wall part; and a sheet-shaped part provided around the burring wall part and connected to the bent wall part, wherein a thickness T of the sheet-shaped part is 2.0 mm or more, an indicator relating to toughness and cracking at an inside bend of the bent wall part Charpy impact value vE(0) of the sheet-shaped part at 0° C. is 50 J/cm$^2$ or more, a BCI value calculated by the following formula (1) based on the Charpy impact value vE(0) and a maximum length Lc of a crack at an inside bend of the bent wall part is 2.5 or more, and a curvature radius R of the inside bend of the bent wall part is larger than R1 calculated by the following formula (2):

$$BCI = vE(0)/Lc \quad (1)$$

$$R1 = 25/BCI - 1.5 \quad (2)$$

where, the unit of vE(0) is J/cm$^2$, the unit of Lc is μm, and the unit of R1 is mm, and wherein R/BCI defines a curve and identifies pass values and fail values of R1 calculated in the formula (2), and the curvature radius R is selected based on the pass values identified by the curve.

2. The burring structural member according to claim 1, wherein the curvature radius R of the bent wall part is 0.5 mm or more and 10.0 mm or less.

3. The burring structural member according to claim 1, wherein the thickness T of the sheet-shaped part is 2.0 mm or more and 8.0 mm or less.

4. The burring structural member according to claim 1, wherein a tensile strength TS of the sheet-shaped part is 780 MPa or more.

5. The burring structural member according to claim 4, wherein the tensile strength TS of the sheet-shaped part is 980 MPa or more.

* * * * *